US006226869B1

(12) United States Patent
Heintke et al.

(10) Patent No.: US 6,226,869 B1
(45) Date of Patent: May 8, 2001

(54) ELECTRIC SHAVER

(75) Inventors: Hans-Eberhard Heintke, Wächtersbach; Peter Hilfinger, Bad Homburg; Klaus Oprach, Schwalbach; Roland Ullmann, Offenbach; Matthias Wetzel, Schöneck-Büdesheim, all of (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 09/202,767

(22) PCT Filed: Jun. 30, 1997

(86) PCT No.: PCT/EP97/03402

§ 371 Date: Dec. 21, 1998

§ 102(e) Date: Dec. 21, 1998

(87) PCT Pub. No.: WO98/07550

PCT Pub. Date: Feb. 26, 1998

(30) Foreign Application Priority Data

Aug. 22, 1996 (DE) ..... 196 33 824

(51) Int. Cl.[7] ..... B26B 19/20
(52) U.S. Cl. ..... 30/34.1; 30/43.1; 30/43.9
(58) Field of Search ..... 30/34.1, 43.92, 30/43.1, 43.9, 34.05, 346.51

(56) References Cited

U.S. PATENT DOCUMENTS 4,233,733 * 11/1980 Gallanis ..... 30/43.92
4,866,843 * 9/1989 Kumano ..... 30/34.1
4,922,608 * 5/1990 Pahl ..... 30/34.1 X
5,022,153 * 6/1991 Baron ..... 30/34.1
5,084,967 * 2/1992 Nakagawa et al. ..... 30/34.1
5,386,631 * 2/1995 Van Asten et al. ..... 30/34.1
5,507,095 * 4/1996 Wetzel et al. ..... 30/34.1

FOREIGN PATENT DOCUMENTS 27 01 223 7/1977 (DE) .
2 199 529 7/1988 (GB) .
37 43 181 A1 7/1988 (DE) .

* cited by examiner

*Primary Examiner*—M. Rachuba
(74) *Attorney, Agent, or Firm*—Fish & Richardson P.C.

(57) ABSTRACT

The invention is directed to an electrically operable shaving apparatus (1) including at least one short-hair cutter (3) and a long-hair trimmer unit (2) disposed on a housing, with at least one cutting edge formed by cutting teeth of an outer cutter and an inner cutter, in which a component (4), which acts as a guard protecting the skin, is associated with the cutting edge in at least one operating position, said component (4) ceasing to act as a guard protecting the skin in at least one further operating position, wherein said component (4) is displaceable in conjunction with the long-hair trimmer unit (2) into at least one operating position in which said component (4) acts as a guard protecting the skin, and wherein on displacement into a further operating position the long-hair trimmer unit (2) is released by relative opposing movements of the long-hair trimmer unit (2) and the component (4).

11 Claims, 5 Drawing Sheets

ELECTRIC SHAVER

This invention relates to an electrically operable shaving apparatus.

From DE 27 01 223 A1 a dry shaving apparatus is known having a short-hair cutter unit and a long-hair trimmer unit with two cutting edges extending in a spaced relationship to each other, each formed by a common stationary and a common movable cutting element. Associated with the long-hair trimmer unit is a spring-mounted guard member, such that the one or the other cutting edge can be covered by the guard member through operation of a slidably disposed actuating switch.

It is an object of the present invention to improve the known electrically operable shaving apparatus.

In a shaving apparatus of the type initially referred to, this object is accomplished according to some features of the invention.

These features show to advantage that the possibility of irritation of the user's skin can be largely obviated. When in the use of the combination shave described the comparatively sharp-edged cutting teeth of the long-hair trimmer unit are guided over the skin using a sequence of motions normal for a typical shave, it has shown that skin irritations may occur. With the dry shaver embodiment of the present invention, a component acting as a skin protecting element is associated with the cutting edge of the long-hair trimmer unit in this first operating position. This enables such skin irritation to be avoided to advantage. The long-hair trimmer's function is also maintained when the skin protecting element is associated with the cutting edge. The component may have the effect of a comb for introducing the hairs, for example. Also, the component itself may be configured as a long-hair trimmer. In this configuration it shows to advantage that the component prevents the cutting teeth of the long-hair trimmer to come into direct contact with the user's skin. When one of the further operating positions is reached subsequently, the component ceases to act as a guard protecting the skin. The long-hair trimmer can then be used to advantage for trimming hairs or for cutting contours. For these operations is advantageous for the cutting teeth to be in engagement with the skin to allow a precise cut.

A further embodiment implements of an automatically correct positioning of the long-hair trimmer unit and the component. It will be understood, of course, that it is also possible for the long-hair trimmer unit and the component to be moved one after the other—at least in part—instead of being moved at the same time.

The possibility also exists to move the long-hair trimmer unit and the component one after the other—at least in part—, rather than moving them at the same time.

Other embodiments provision for a slide switch acting as an On/Off switch in addition to enabling the long-hair trimmer unit to be set to several operating positions by being shifted into various positions. This makes handling of the electrically operable shaving apparatus a particularly easy matter.

Still other embodiments include a particularly straightforward construction in which the position of the component relative to the cutting edge is variable by means of a separate control element.

When the long-hair trimmer unit of the electrically operable shaving apparatus is floatingly mounted, the floating arrangement of the long-hair trimmer unit enables the tangent to adjust itself to the facial contours and the angle of inclination at which the shaving apparatus is held.

In another embodiment, the component floats together with the long-hair trimmer unit in the corresponding operating position. In this arrangement, the component is in a position to fulfill its function as a skin protecting element optimally, while at the same time any impairment of the function of the long-hair trimmer unit is kept at a minimum possible level.

An advantageous feature of some embodiments prevents that on a downward floating movement the long-hair trimmer unit and/or the component are shifted out of this operating position should the user exert too much pressure on the shaving apparatus. Using excessive pressure could, for example, cause the long-hair trimmer unit to be moved to its Off position. To prevent this from occurring, this arrangement therefore includes a detent element that is actuated to prevent a downward movement of the long-hair trimmer unit out of this particular operating position.

With the feature of the shaving apparatus according to another embodiment high trimming or cutting precision is accomplished because the long-hair trimmer unit, rather than floating in this operating position, is held in a fixed position preventing it from floating.

In another embodiment of a shaving apparatus, the function is achievable with a comparatively low number of necessary components. In this embodiment, the component can be held in the fixed position corresponding to the first operating position. The spring is then tensed on further movement of the long-hair trimmer unit into the corresponding further operating position.

However, the component is also movable in opposition to the direction of movement of the long-hair trimmer unit if the direction of force of the spring acting on the component reverses when the long-hair trimmer unit is moved into the corresponding further operating position.

An embodiment of the present invention is illustrated in more detail in the accompanying drawings, in which.

Figures 1, 2, 3, 4:
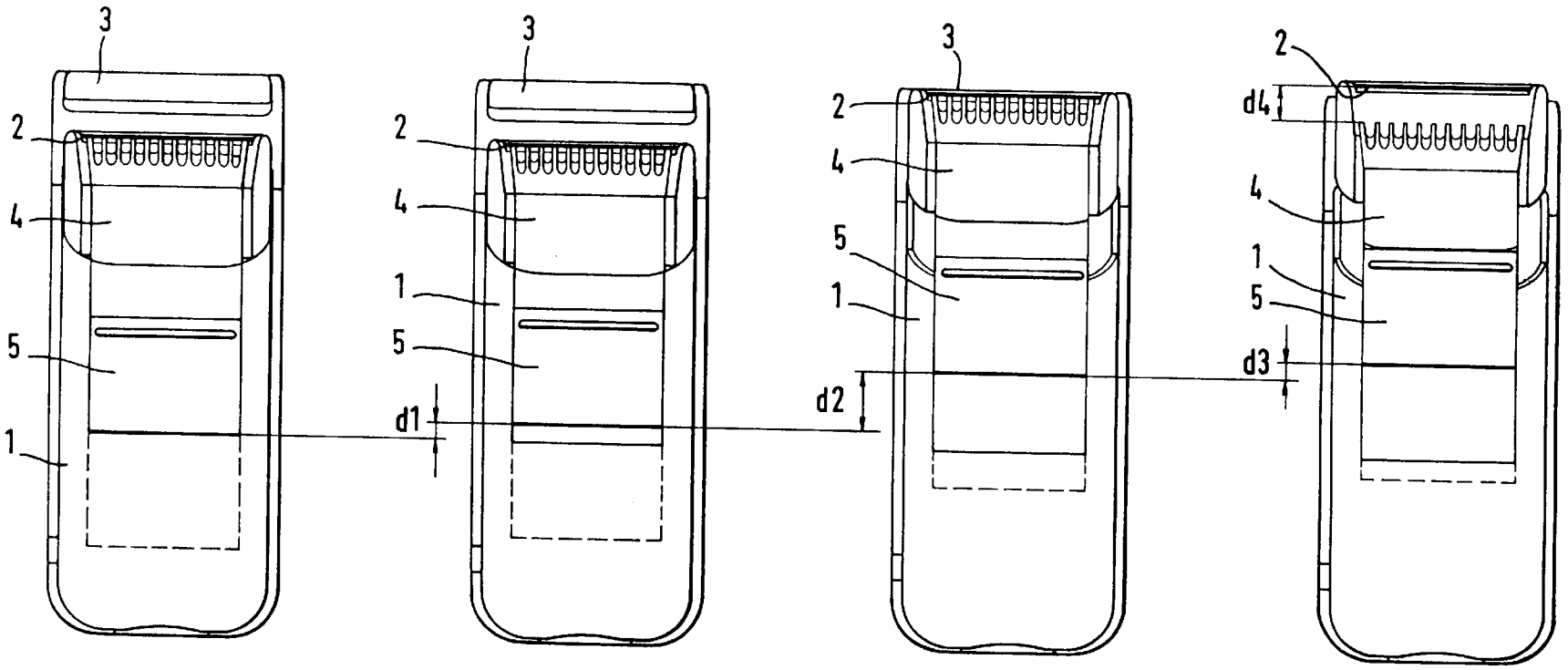
FIGS. 1 to 4 are views of the long-hair trimmer unit and the component illustrating various operating positions thereof.

Referring now to FIGS. 1 to 4, there is shown an electrically operable shaving apparatus 1 in which various operating positions can be selected by means of a slide switch 5. The electrically operable shaving apparatus 1 accordingly includes a short-hair cutter 3, a long-hair trimmer unit 2, and a component 4. In some operating positions this component 4 is associated with the long-hair trimmer unit 2 such as to function as a guard protecting the user's skin. In the embodiment shown, the short-hair cutter 3 is a foil cutter. The long-hair trimmer unit 2 is displaceable along the length of the shaving apparatus 1 into various operating positions.

FIG. 1 shows the shaving apparatus 1 in its Off state. In this position the long-hair trimmer unit 2 is in its fully retracted position.

In the representation of FIG. 2, the shaving apparatus 1 is switched on by pushing the slide switch 5 upwards by a distance d1. The long-hair trimmer unit 2 is still in its fully retracted position. The distance d1 may be 4 mm, for example. The shaving apparatus 1 is now activated. The long-hair trimmer unit 2 does not operate in this position. With the slide switch 5 in the position shown in FIG. 2, only the short-hair cutter 3 can be used for shaving.

In the representation of FIG. 3, the slide switch 5 is shown as pushed upwards by a distance d2 relative to the representation of FIG. 2. This distance d2 may amount to 14 mm, for example. Pushing the slide switch 5 by this distance also involves an upward movement of the long-hair trimmer unit 2 which is turned on in the process. As appears further from FIG. 3, the component 4 is equally moved upwards a corresponding amount, acting in this first operating position as a guard to protect the skin from the cutting edge of the long-hair trimmer unit 2.

In FIG. 3, the positions of the long-hair trimmer unit 2 and of the component 4 correspond to a shave referred to as combination shave. In a combination shave, a cutting plane is formed by a tangent or tangential plane determined by the short-hair cutter 3, the long-hair trimmer unit 2 and the component 4. While shaving, the user thus guides both the long-hair trimmer unit 2, in combination with the component 4 acting as skin protecting element, and the short-hair cutter 3 over the skin. In the process, the long-hair trimmer unit 2 performs cutting on its front and rear side. It is thereby ensured that long hairs are caught as reliably as possible during a to-and-fro motion while shaving. If, when looking in the direction of movement of the shaving apparatus 1, the component 4 is behind the long-hair trimmer unit 2 during the shave, the short-hair cutter 3 situated in front of the long-hair trimmer unit 2 operates to protect the skin. Providing a further component 4 acting as skin protecting element on the other side of the long-hair trimmer unit 2 may however also be contemplated.

The long-hair trimmer unit 2 may also be of a floating configuration, hence enabling an adjustment of the tangential plane to the user's skin surface as well as to an angle, possibly subjected to fluctuations, at which the user holds the shaving apparatus against his skin.

In the representation of FIG. 4 the slide switch 5 is shown as pushed upwards by a distance d3 relative to the representation of FIG. 3. This distance d3 may amount to 4 mm, for example.

In this position the component 4 acts no longer as a skin protecting element for the long-hair trimmer unit 2. In contrast to the position illustrated in FIG. 3, the long-hair trimmer unit 2 is moved upwards into a position beyond the short-hair cutter 3. In addition, the component 4 is moved downwards. Accordingly, as a result of the relative opposing movements of the long-hair trimmer unit 2 and the component 4, a distance d4 is produced between the cutting edge of the long-hair trimmer unit 2 and the component 4. This permits particularly precise trimming. The distance d4 between the cutting edge and the component 4 may amount to 8 mm, for example.

In the position shown in FIG. 4, the long-hair trimmer unit may be locked against a floating motion. This enables a particularly accurate contour cut to be achieved when trimming the hairs.

Figure 7:
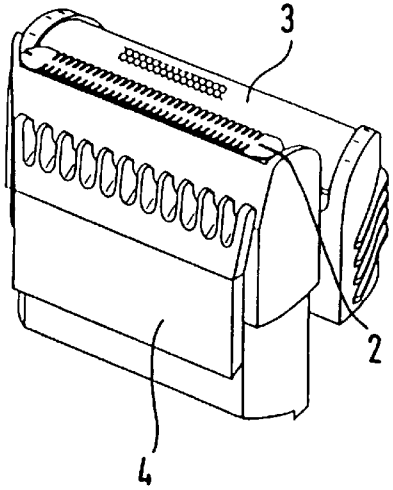
FIGS. 5 to 7 are views of different positions of the component relative to the long-hair trimmer unit in the presence of different operating positions.
Figure 6:
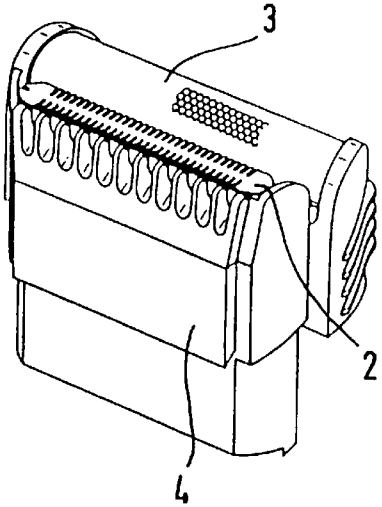
Figure 5:
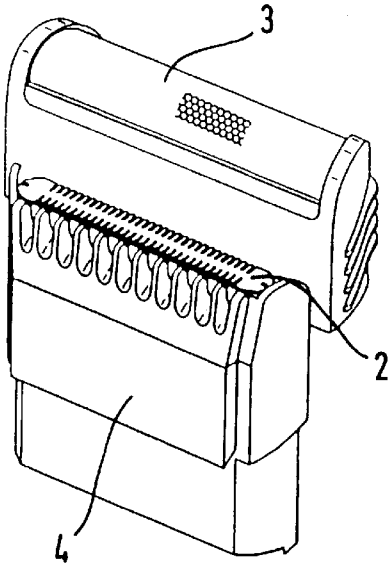

FIGS. 5 to 7 show in a detail view different positions of the component 4 relative to the long-hair trimmer unit 2 in the presence of different operating positions. FIG. 5 corresponds to a detail view of FIGS. 1 and 2, FIG. 6 corresponds to a detail view of FIG. 3, and FIG. 7 corresponds to a detail view of FIG. 4.

Figure 8:
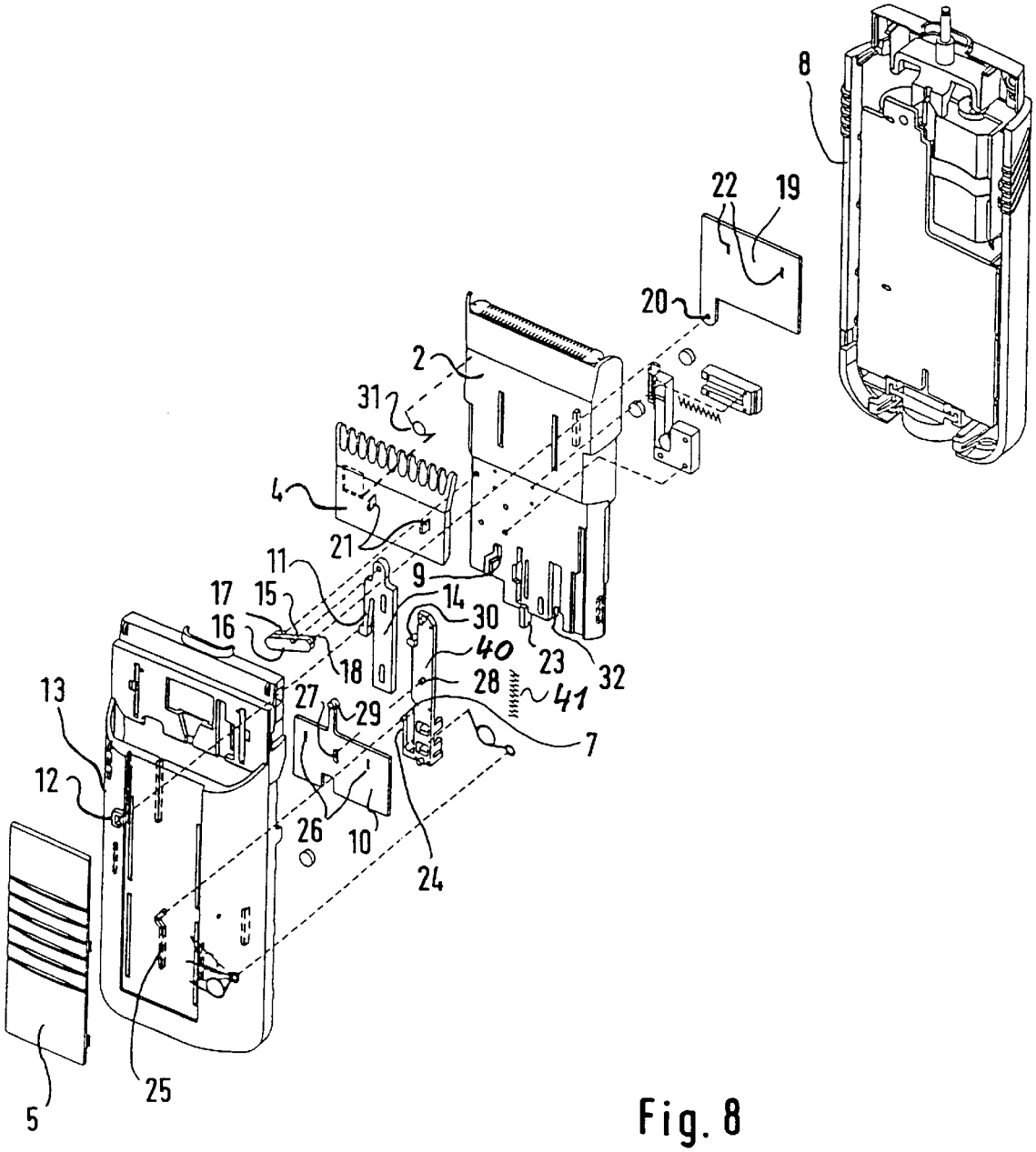
FIG. 8 is an exploded view of a shaver's mechanics illustrating a first embodiment involving actuation by means of a single slide control.

FIG. 8 shows in an exploded view a first embodiment of the mechanical structure by means of which a corresponding movement of the long-hair trimmer unit 2 and the component 4 can be accomplished. In the embodiment illustrated in FIG. 8, actuation is by means of a single slide switch 5. Movement of this slide switch 5 thus effects both activation/deactivation of the shaving apparatus 1 and, on an appropriate further movement of the slide switch 5, a corresponding movement of the long-hair trimmer unit 2 and the component 4 as well.

The long-hair trimmer unit 2 is longitudinally displaceably mounted on the basic body 8 of the electric shaving apparatus 1.

When the long-hair trimmer unit 2 is moved upwards from its fully retracted position which it occupies in the off state of the shaving apparatus 1, the component 4 is initially compelled to follow it in this movement. The component 4 is thus associated with the long-hair trimmer unit 2 to function as a skin protecting element. This first operating position—also referred to as combination shave—permits a gentle shave.

On movement of the long-hair trimmer unit 2 farther upwards into a further operating position, the coulisse 9 on the longhair trimmer unit 2 has the effect of causing engagement of the detent hook 11 with the stop 12 on the housing portion 13. This prevents the detent plate 14 from moving farther upwards. This then also holds the fulcrum 15 of the lever 16 in position.

The bearing point 17 of the lever 16 is moved farther upwards together with the long-hair trimmer unit 2. Because the fulcrum 15 is fixed in position, the bearing point 18 is moved downwards a corresponding amount. Considering that in the embodiment shown the lever arms are of equal length, the bearing point 18 is thus moved downwards the same amount by which the bearing point 17 is moved upwards. The movement of the bearing point 18 causes the component 4 to be moved downwards as well. The bearing point 18 engages within a corresponding hole 20 of an intermediate member 19. The component 4 in turn is connected with the intermediate member 19 by means of noses 21 engaging in registering openings 22 in the intermediate member 19.

Thus there occur relative opposing movements of the long-hair trimmer unit 2 and the component 4. While the component 4 is moved downwards, the long-hair trimmer unit 2 is moved upwards. This position permits trimming of the hairs because the long-hair trimmer unit 2 and the component 4 are at a comparatively large relative distance, enabling the user to observe the cutting edge of the long-hair trimmer unit 2 well.

When the slide switch 5 is moved downwards again, the whole process is repeated in reverse order. The long-hair trimmer unit 2 and the component 4 are then again in such relative position in the first operating position that the component 4 operates as a skin protecting element.

When the shaving apparatus 1 is subsequently turned off by a further downward movement of the slide switch 5, the long-hair trimmer unit 2 together with the component 4 occupies again its fully retracted position. The coulisse 9 on the long-hair trimmer unit 2 has then released the detent hook 11 of the detent plate 14 for disengagement from the stop 12 on the housing portion 13.

The first operating position (combination shave), furthermore enables a floating motion of the long-hair trimmer unit 2. To this effect, the long-hair trimmer unit 2 takes support upon the abutment element 40 by means of a spring 41. In the first operating position this enables the long-hair trimmer unit 2 to float, moving relative to the abutment element 40 downwards. As the downward movement of the long-hair trimmer unit 2 relative to the abutment element 40 proceeds, the nose 23 of the long-hair trimmer unit 2 urges the detent hook 24 of the abutment element 40 away from the abutment element 40. In the presence of a downward movement, the detent hook 24 is moved along the guide opening 25 of the housing portion 13. With the detent hook 24 then reaching the position of the recess in the guide opening 24, and the nose 23 of the long-hair trimmer unit 2 preventing, in the lowermost position of the floating motion, the detent hook 24 from moving again towards the abutment element 40, a further downward movement of the long-hair trimmer unit 2 is prevented from occurring. This thus eliminates the possibility for the long-hair trimmer unit 2 to slip" out of the respective operating position because of the floating motion having reached its limit position (lowermost position).

In the embodiment of FIG. 8, the connection of the long-hair trimmer unit 2 with the slide switch 5 is effected by engagement of corresponding projections on the slide switch 5 within the two openings 26 in the slide 10. The slide 10 is thereby coupled up with the slide switch 5. Further the pin 28 on the abutment element 40 engages within the elongate slot 27 on the slide 10. When the shaving apparatus 1 is turned on, the slide switch 5 is initially moved until the projection 29 on the slide 10 travels over the cam 30 on the abutment element 40. The pin 28 of the abutment element 40 rests against the lower end of the elongate slot 27 in the slide 10. On movement of the slide switch 5 and hence the slide 10 farther upwards, the abutment element 40 is likewise moved upwards through the elongate slot 27 and the pin 28. In the process, the long-hair trimmer unit 2 bears by means of the spring 41 against the abutment element 40, being consequently moved upwards as well. The elastic spring 31 operates to move the component 4 together with the long-hair trimmer unit 2 upwards until the coulisse 9, through operation of the detent hook 11, inhibits further upward movement of the detent plate 14. Then the above-described function involving the cooperation of the component 4, the lever 16 and the detent plate 14 occurs, as a result of which the component 4 moves in opposition to the direction of movement of the long-hair trimmer unit 2.

The downward movement of the long-hair trimmer unit 2 is effected in that a hook, not shown in greater detail, is provided on the rear side of the abutment element 40, which hook engages the opening 32 of the long-hair trimmer unit 2 during the downward movement, compelling the trimmer to follow it in its downward travel.

Figure 9:
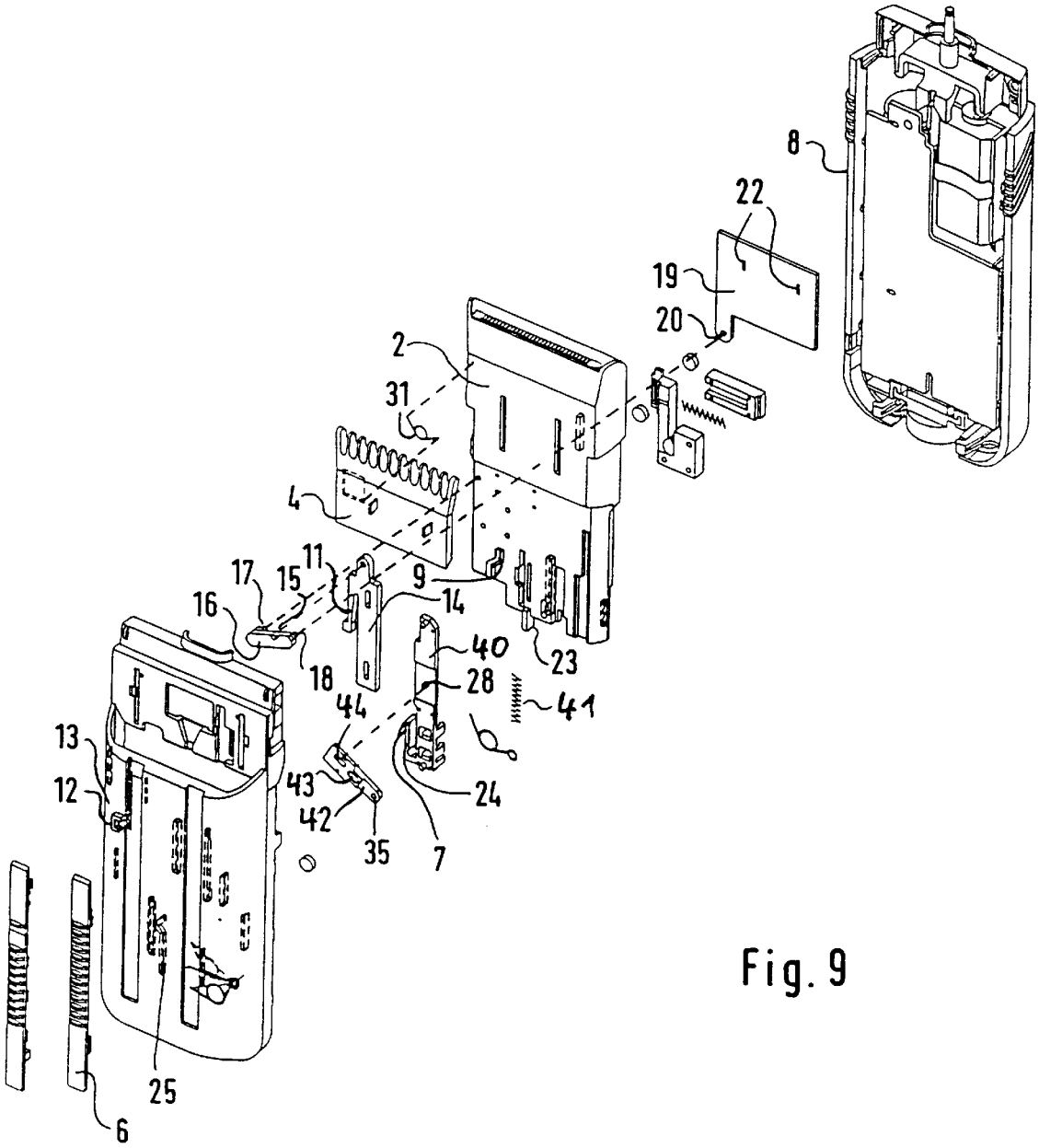
FIG. 9 is an exploded view of the shaver's mechanics according to the first embodiment but utilizing an On/Off switch and a further switch for selecting the operating positions.

In the representation of FIG. 9, like parts are assigned like reference numerals as in the embodiment of FIG. 8. A more detailed explanation of the components and their function can therefore be dispensed with. In the embodiment of FIG. 9, a control element 6 is provided by means of which the long-hair trimmer unit 2 is moved. Independently thereof, a further control element is provided having the sole function of turning the shaving apparatus 1 on and off.

The control element 6 engages the central opening 43 of the lever 42. The pin 28 engages within the outer opening 44 of the lever 42. At point 35 the lever 42 is fixedly attached to the housing portion 13. When the control element 6 is moved upwards, the abutment element 40 is moved upwards via the lever 42 by a correspondingly greater distance.

In the embodiment of FIG. 9 the movement of the long-hair trimmer unit 2 and the component 4 functions in the same manner as in the embodiment of FIG. 8. The lever 42 is provided in the embodiment of FIG. 9 as a substitute for the slide 10 in the embodiment of FIG. 8.

Figure 10:
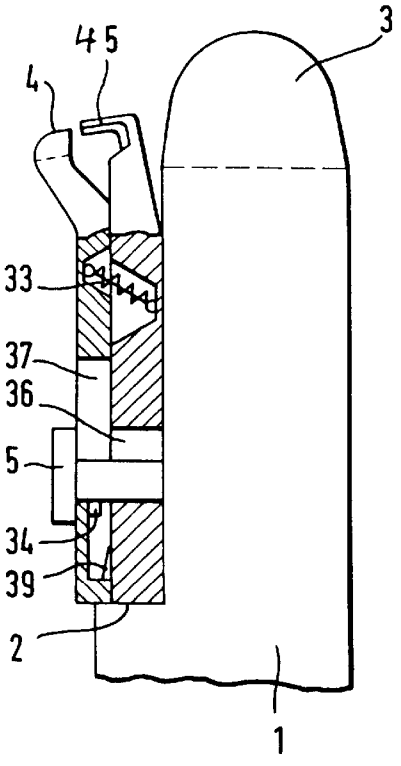

FIG. 10 shows an electric shaving apparatus 1 in a side elevation. The shaving apparatus 1 is illustrated in its Off state. The shaving apparatus 1 includes a long-hair trimmer unit 2 which may have a component 4 associated with its cutting edge 45 to protect the user's skin.

Figure 11:
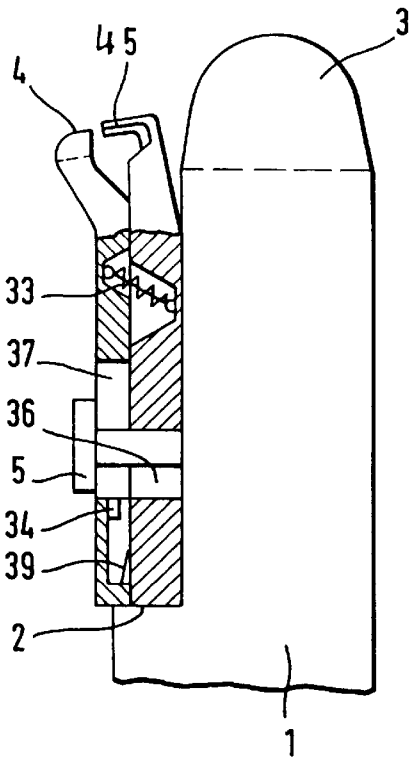

In the position of the slide switch 5 illustrated in FIG. 11, the shaving apparatus 1 is in the on state. This involves movement of the slide switch 5 in the openings 36 and 37 of the long-hair trimmer unit 2 and the component 4. These openings 36 and 37 are dimensioned such that the slide switch 5, as it moves into the position of FIG. 11, has not as yet compelled the long-hair trimmer unit 2 to follow it in movement. The shaving apparatus 1 is now in activated condition. The short-hair cutter 3 is ready for a shave.

Figure 12:
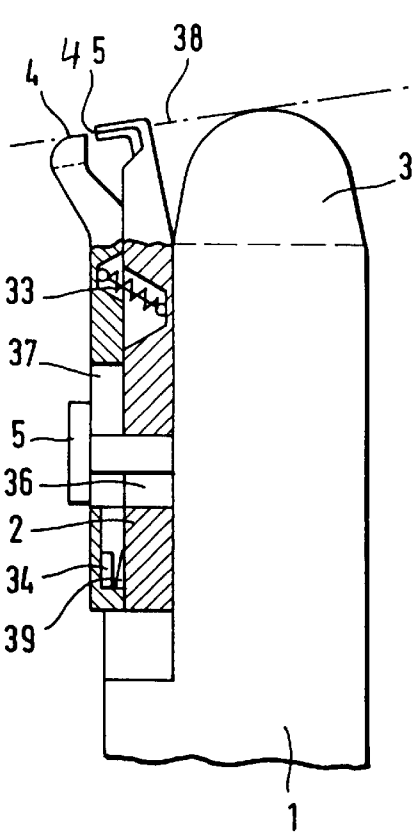

In the position illustrated in FIG. 12, the shave referred to as combination shave is possible, involving operation of the long-hair trimmer unit 2 with its associated component 4. Component 4 then acts as a guard to protect the skin. The short-hair cutter 3 is also in operation. In this first operating position, the short-hair cutter 3, the long-hair trimmer unit 2 and the component 4 combine to form a surface against which the tangent 38 may be applied. Hence a shave can then be performed in which the short-hair cutter 3, the long-hair trimmer unit 2 and the component 4, which in this operating position is associated with the long-hair trimmer unit 2 and acts as a guard to protect the skin, engage the skin all at the same time. As it travels from the position of FIG. 11 to the position of FIG. 12, the slide switch 5 compels the long-hair trimmer unit 2 to follow it in motion due to the dimensioning of the opening 36 of the long-hair trimmer unit 2. Through the spring 33, the component 4 is equally compelled to occupy the position shown in FIG. 12 in which this component 4 acts as a guard for the long-hair trimmer unit 2 to protect the user's skin. As can be seen further, in the position shown in FIG. 12 the component 4 rests against the stop 34 of the housing of the shaving apparatus 1.

Figure 13:
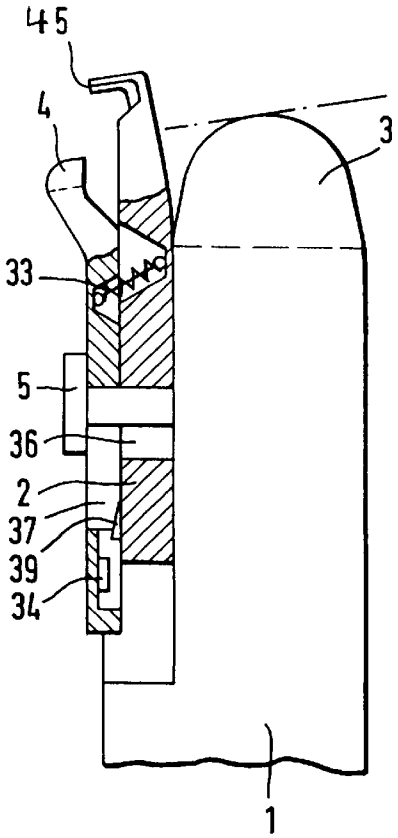
FIGS. 10 to 13 are views of a further embodiment.

When the slide switch 5 is moved farther upwards as shown in FIG. 13, the long-hair trimmer unit 2 continues to follow this upward movement. The component 4 however is held back on the stop 34. By virtue of the dimensioning of the opening 37 of the component 4, the slide switch 5 is in a position to move farther upwards without compelling the component 4 to follow it in motion. Because of the dimensions of the spring 33 with regard to its end supports on the component 4 and on the long-hair trimmer unit 2, the direction of force of the spring 33 acting on the component 4 is reversed. After the end support of the spring 33 on the long-hair trimmer unit 2 has reached a point beyond the reversal point, the component 4 is moved downwards in opposition to the direction of movement of the long-hair trimmer unit 2. Thus the component 4 is again at a certain relative distance to the stop 34.

During downward movement of the long-hair trimmer unit 2 the component 4 is caused to follow it in movement, supported not only by spring force but also by the action of a cam 39.

What is claimed is:

1. An electrically operable shaving apparatus for cutting hair growing on skin, the apparatus comprising:

a housing, a short-hair cutter, a movable long-hair trimmer unit disposed on the housing, having at least one cutting edge including an outer cutter and an inner cutter, a movable guard for protecting the skin from the cutting edge, and a slide switch for moving the guard and the long-hair trimmer unit, wherein the slide switch moves the guard and the long-hair trimmer unit into a first operating position in which the guard protects the skin, and wherein the slide switch releases the long-hair trimmer unit in a second operating position by moving the guard and the long hair trimmer unit in relative opposing movements.

2. The electrically operable shaving apparatus according to claim 1, wherein the the slide switch moves the guard into a position in which the guard protects the skin before the long-hair trimmer unit has reached the first operating position.

3. The electrically operable shaving apparatus according to claim 1, wherein the slide switch moves the guard into a position in which the guard does not protect the skin when the long-hair trimmer is between the first and the second operating positions.

4. The electrically operable shaving apparatus according to claim 1, wherein the slide switch acts as an On/Off switch.

5. The electrically operable shaving apparatus according to claim 1, further comprising a control element for moving the guard relative to the cutting edge.

6. The electrically operable shaving apparatus according to claim 1, wherein the long-hair trimmer unit is floatingly mounted in the first operating position.

7. The electrically operable shaving apparatus according to claim 6, wherein the guard floats together with the long-hair trimmer unit in the first operating position.

8. The electrically operable shaving apparatus according to any one of the claims 6 or 7, further comprising a detent element that is actuated, on a downward floating movement of at least one of the long hair trimmer unit and the guard, the detent element preventing the floating movement from moving the long-hair trimmer out of the first operating position.

9. The electrically operable shaving apparatus according to claim 6, wherein the long-hair trimmer unit is prevented from floating in at least one other operating positions.

10. The electrically operable shaving apparatus according to claim 1, further comprising:

a spring that connects the guard with the long-hair trimmer unit, and a stop formed on the housing, wherein the guard rests against the stop in the first operating position, thereby preventing movement of the guard and the long-hair trimmer unit out of the first operating position.

11. The electrically operable shaving apparatus according to claim 10 wherein the direction of force of the spring acting on the guard reverses when the slide switch moves the long-hair trimmer unit out of the first operating position.

* * * * *

UNITED STATES PATENT AND TRADEMARK OFFICE

CERTIFICATE OF CORRECTION

PATENT NO. : 6,226,869 B1 
DATED : May 8, 2001
INVENTOR(S) : Hans-Eberhard Heintke, Peter Hilfinger, Klaus Oprach, Roland Ullmann and Matthias Wetzel It is certified that error appears in the above-identified patent and that said Letters Patent is hereby corrected as shown below:

Column 6,
Line 65, delete "slide switch" and insert -- control mechanism --;
Line 66, delete "slide switch" and insert -- control mechanism --.

Column 7,
Line 2, delete "slide switch" and insert -- control mechanism --;
Line 3, after "guard" insert -- in a first direction --; after "and" insert -- moving --;
Line 4, delete "relative opposing movements" and insert -- a second direction opposite to the first direction --.
Line 7, delete "the slide switch" and insert -- control mechanism --.
Line 13, delete "slide switch" and insert -- control mechanism --.
Line 19, delete "slide switch" and insert -- control mechanism --; after "switch" (second occurrence) insert -- for turning the shaving apparatus on and off --.
Line 22, delete "control" and insert -- switching --; delete "moving the guard relative to the cutting edge" and insert -- turning the shaving apparatus on and off --.

Column 8,
Line 27, delete "slide switch" and insert -- control mechanism --.

Signed and Sealed this

Thirteenth Day of August, 2002

*Attest:*

*Attesting Officer*

JAMES E. ROGAN
*Director of the United States Patent and Trademark Office*